US005650716A

United States Patent [19]

Kim

[11] Patent Number: 5,650,716

[45] Date of Patent: Jul. 22, 1997

[54] TIMER DEVICE CONTROLLED BY A SWITCH

[75] Inventor: Beom Ryong Kim, Seoul, Rep. of Korea

[73] Assignee: L.A. Gear, Inc., Santa Monica, Calif.

[21] Appl. No.: 365,839

[22] Filed: Dec. 29, 1994

[30] Foreign Application Priority Data

Dec. 31, 1993 [KR] Rep. of Korea ..... 93-32267

[51] Int. Cl.[6] ..... G05F 1/00

[52] U.S. Cl. ..... 323/282

[58] Field of Search ..... 323/282, 280–281; 315/291, 307

[56] References Cited

U.S. PATENT DOCUMENTS 5,396,155 3/1995 Bezdon et al. ..... 315/291

*Primary Examiner*—Aditya Krishnan
*Attorney, Agent, or Firm*—L.A. Gear, Inc.

[57] ABSTRACT

According to the timer device of the invention, a time-setting part supplied from the power supply sets up the period from the opening instance of said switch to the instance that the magnitude of current in the capacitor comes down under a specified value, as said current-supply period, and a current-controlling part allows the current to flow from said power supply to said load during said current-supply period determined by said time-setting part, and a switch makes the time-setting part operate at opening instance of the switch.

Therefore, the timer device of the invention can reduce the loss of power during the waiting period. And when the magnitude of the current flowing through the time-setting part and the current-controlling part in open-state of the switch, in order that the decrement of the current in the current-controlling part makes the current in the time-setting part rapidly decrease, these parts are interconnected with each other.

The timer device of the invention as mentioned above provide effects that it can reduce the recovering time to prepare for the sequential operation, and makes the magnitude of the current supplied from the power supply to the load stable.

6 Claims, 2 Drawing Sheets

TIMER DEVICE CONTROLLED BY A SWITCH

Figure 1:
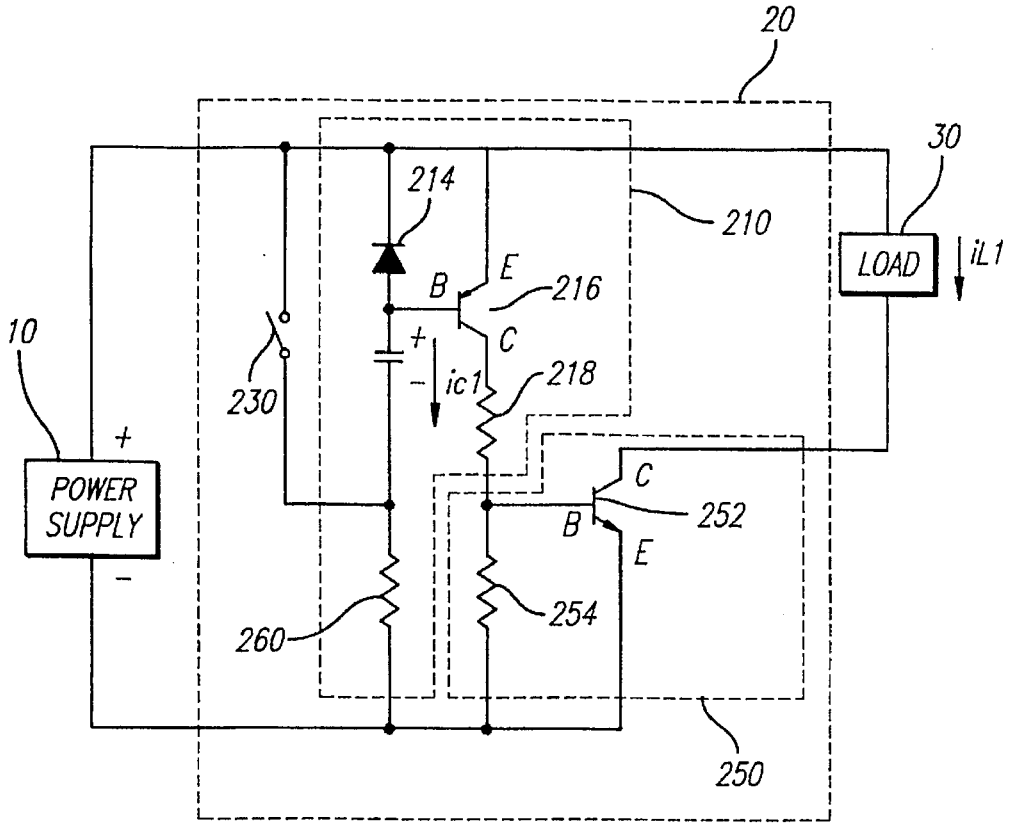
FIG. 1 is a circuit diagram of the timer device in accordance with a preferred embodiment of the invention.

BRIEF DESCRIPTION OF THE REFERENCE NUMERALS DESIGNATING MAIN PARTS OF THE DRAWINGS

20: a timer device
212: a capacitor
216, 252: transistors
230: a switch
210: a timer-setting part
214: a diode
218, 254, 260, 360: resistors
250: a current-controlling part

DETAILED DESCRIPTION OF THE INVENTION

This invention relates to a timer device controlled by a switch, and particularly to a timer device which supplies the current from the power supply to the load in the predetermined period as the switch is opened.

Typically, a timer device keeps operating in specified period from closed instance of a switch. It has previously been proposed to provide a timer device which has a electric relay or a active element and begins to operate as the switch is opened. Several problems of this timer device are that the power is dissipated in the electric relay or in the active element during the waiting period and the operating or stopping state of the timer is unstable. Furthermore, in order to overcome these problems, a circuitry of the timer device has become very complicated.

A primary object of the invention is to provide a improved timer device which controls the current supplied from the power supply to the load according to the magnitude of current in the capacitor, whereby the timer device exactly controls the operation of the load, and the dissipated power is also very small during the waiting period for recovering of the operation of the timer.

Accordingly, an object of the invention is to provide a timer device for controlling the current supplied from a power supply to a load, which comprises an on/off switch, a time-setting part which is charged by said power supply in open-state of said switch and is discharged in closed-state of said switch, whereby said time-setting part sets up a current-supply period according to the magnitude of current charged by said power supply, and a current-controlling part which allows the current to flow from said power supply to said load during said current-supply period determined by said time-setting part.

Several embodiments of the invention will be described with reference to the accompanying drawings wherein.

FIG. 1 shows a circuit diagram of a timer device in accordance with a preferred embodiment of the invention. The precisely circuitry of the timer device is disposed between the power supply (10) and the load (30), and controls the current supplied from the power supply (10) to the load (30). The timer device (20) comprises a switch (230); a time-setting part (210) having a capacitor (212), a diode (214), a PNP transistor (216) as the first transistor and a resistor (218); and a current-controlling part (250) having an NPN transistor (252) as the second transistor and a resistor (254). The anode and the cathode of the diode (214) are connected to the anode of the capacitor (212) and the positive electrode of the power supply (10), respectively. In other words, the diode is disposed between the power supply (10) and the capacitor (212) with reverse-biased connection thereto. The capacitor (212) is connected to the resistor (260) which is connected to the negative electrode of the power supply (10). The first transistor has its base (B) connected to the node disposed between the capacitor (212) and the diode (214), and its emitter (E) connected to the node disposed between the power supply (10) and the load (30), respectively. The switch (230) is disposed between the power supply (10) and the cathode of the capacitor (212). In the second transistor (252) of the current-controlling part (250), its collector (C) is connected to the load (30) for allowing the current to flow from the load to the second transistor, and its emitter (E) is connected to the negative electrode of the power supply (10), and its base (B) is connected to the node between the resistor (218) connected to the collector (C) of the first transistor (216) and the resistor (254) connected to the negative electrode of the power supply (10).

Figure 2A:
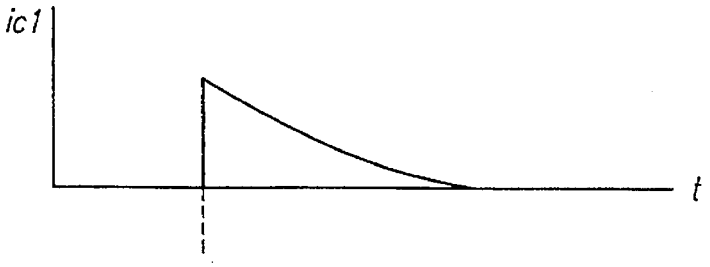
FIG. 2(*a*) and FIG. 2(*b*) are current wave diagrams of the capacitor and the load shown in FIG. 1.
Figure 2B:
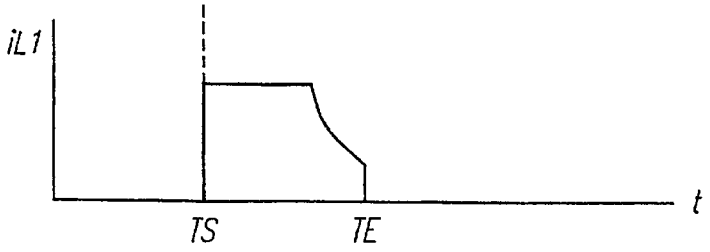

The operating mechanism of the above embodiment will be described with reference to FIG. 2. FIG. 2(*a*) shows the magnitude of the charging current ($i_{C1}$) supplied to the capacitor (212) shown in FIG. 1. FIG. 2(*b*) shows the magnitude of the load current ($i_{L1}$) supplied to the load (30) shown in FIG. 1. In open-state of the switch (230), the current is supplied from the power supply (10) to the capacitor (212) via the emitter (E) and the base (B) of the first transistor (216), sequentially. As much time proceed in open-state of the switch (230), i.e. the time constants of the capacitor (212) and the resistor (260) proceed, the capacitor (212) is fully charged by the power supply (10). There is no charging current ($i_{C1}$) in the fully charged capacitor (212) and therefore, the first transistor (216) is turned to off-state. Consequently, the second transistor (252) is also turned to off-state, and no current is supplied from the power supply (10) to the load (30).

When the switch (230) is turned to closed-state, the current discharged from the capacitor (212) flows to the switch (230) and the diode (214). The current discharged from the capacitor (212) keeps the first transistor (216) and the second transistor (252) in off-state, whereby no current is supplied from the power supply (10) to the load (30).

When the switch (230) is turned to open-state again, the capacitor (212) begins to be charged. "TS" shown in FIG. 2(*b*) represents the opening instance of the switch (230). Shown in FIG. 2(*a*), the charging current ($i_{C1}$) of the capacitor (212) decreases as time proceeds. The time constant of the charging current ($i_{C1}$) is determined by the capacitor (212) and the resistor (260). If there is the charging current ($i_{C1}$) in the circuit, the current flows to the capacitor (212) via the emitter (E) and the base (B) of the first transistor (216), whereby the first transistor (216) and the second transistor (252) are turned to on-state and consequently, the current is supplied from the power supply (10) to the load (30). As time proceeds, the charging current ($i_{C1}$) continuously decreases, whereby the collector current of the first transistor (216) also decreases.

If the magnitude of the collector current of the first transistor (216) comes down under a specified value, then the second transistor (252) cannot keep the constant current determined by the load (30). Therefore, the second transistor (252) is turned to off-state due to the decrement of the current, and no current is supplied from the power supply (10) to the load (30), consequently, "TE" shown in FIG. 2(*b*) represents the turning instance of the second transistor (252) to off-state. As the charging current ($i_{C1}$) further decreases, the first transistor (216) is also turned to off-state.

In the timer device of FIG. 1, there is a loss of power due to the resistor (260) current in closed-state of the switch (230), and due to the capacitor (212) current until the capacitor (212) is fully charged in open-state of the switch (230). But this loss of power is negligible, and there is no loss of power in case that the switch (230) is in open-state for a long time. However, the timer device of FIG. 1, in comparison with that of FIG. 3, has problems that it has a long operating period due to the exponential decrement of the charging current, but cannot rapidly recover to preparing state for the sequential operation. Furthermore; the load operates in unstable condition of the magnitude of the current supplied to that since the timer device cannot cut off the current supplied to the load at the moment that the magnitude of the current supplied from the power supply to the load begins to be decrease.

Figure 3:
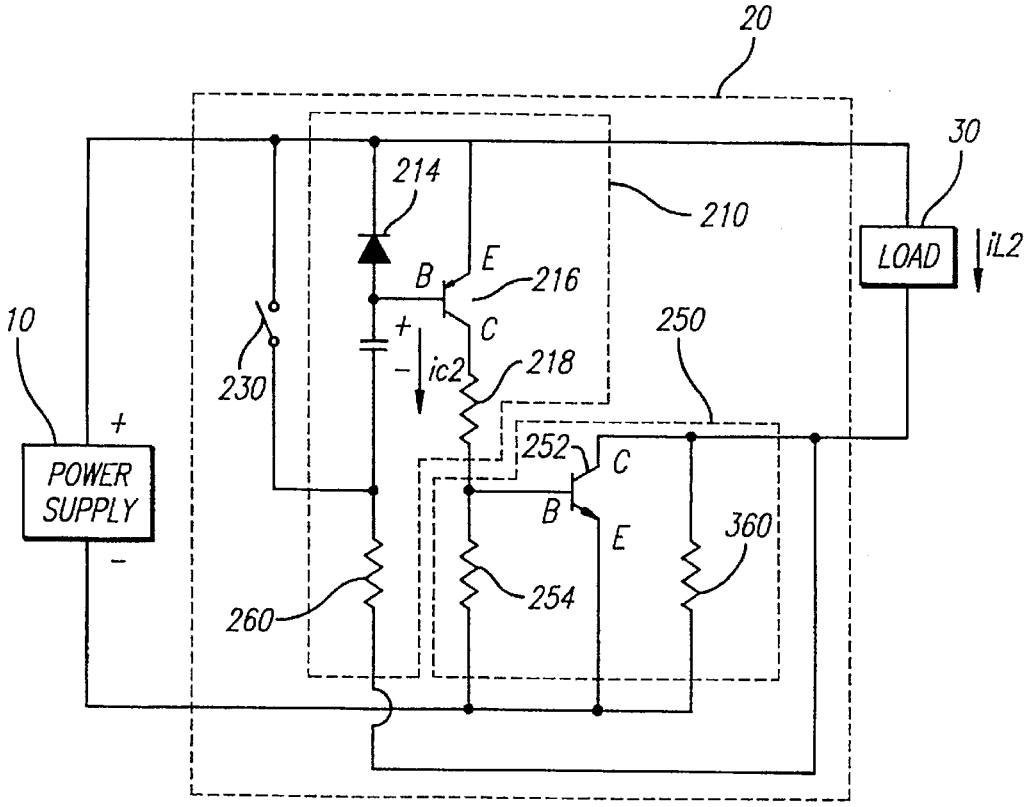
FIG. 3 is a circuit diagram of the timer device in accordance with another preferred embodiment of the invention.
Figure 4A:
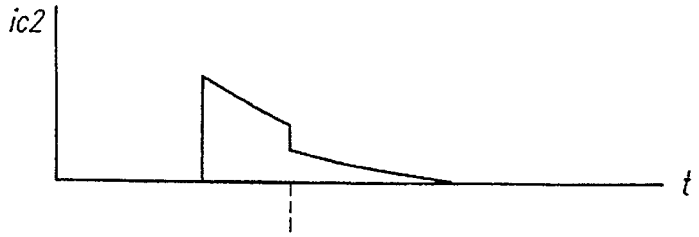
FIG. 4(*a*) and FIG. 4(*b*) are current wave diagrams of the capacitor and the load shown in FIG. 3.
Figure 4B:
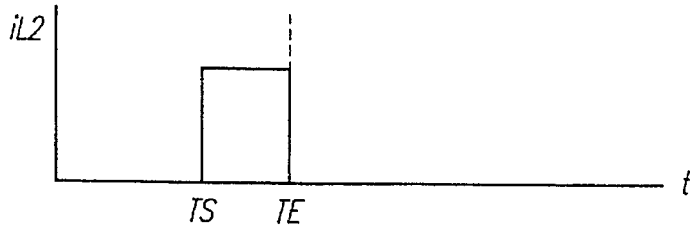

FIG. 3 and FIG. 4 show another embodiment of the invention which solved said problems.

FIG. 3 shows a circuit diagram of a timer device in accordance with another preferred embodiment of the invention. The basic circuitry is the same as that illustrated in FIG. 1, therefore, the reference numerals designating corresponding parts are the same as those in FIG. 1.

There are two significant difference from the circuitry of the first embodiment. One difference between the timer device of FIG. 3 and the first embodiment of FIG. 1 is that the timer device of FIG. 3 further includes the resistor (360) disposed between the power supply (10) and the load (30). The other difference in the embodiment of FIG. 3 is that the cathode of the capacitor (212) is connected to the resistor (260) which is connected not to the negative electrode of the power supply (10) but to the load (30). By virtue of the above circuitry, the timer device of FIG. 3 can quickly cut off the current to the load before the current supplied to the load is turned to unsteady, and can justly operate the sequential operation.

FIG. 4(*a*) shows the magnitude of the charging current ($i_{C2}$) supplied to the capacitor (212) shown in FIG. 3. FIG. 4(*b*) shows the magnitude of the load current ($i_{L2}$) supplied to the load (30) shown in FIG. 3.

As much time proceeds in open-state of the switch (30), the capacitor (212) is fully charged by the current flows via the emitter (E) and the base (B) of the transistor (216), but the transistors (216, 252) are still in off-state. When the capacitor (212) is fully charged, the current is supplied to the load (30) via the resistor (360). However, the magnitude of the load current is negligible if the resistor (360) has large resistance. When the switch (230) is turned to closed-state, the capacitor (212) begins to be discharged but the transistors (216, 252) still keep their off-state. When the switch (230) is turned to open-state again, the capacitor (212) begins to be charged and the transistors (216, 252) are turned to on-state, whereby the current is supplied from the power supply (10) to the load (30). The load current ($i_{L2}$) of the load (30) flows to the power supply (10) via the collector (C) of the second transistor (360).

If the switch (230) keeps its open-state, the capacitor (212) is continuously charged by the charging current ($i_{C2}$) flowing through the emitter (E) and the base (B) of the first transistor (216), the resister (260), the collector (C) and the emitter (E) of the second transistor, sequentially. The charging current ($i_{C2}$) decreases as time proceeds, whereby the collector current of the second transistor (252) cannot keep the constant current determined by the load (30) and also begins to decrease, consequently. The decrement of the collector current of the second transistor (252) makes the charging current ($i_{C2}$) of the capacitor (212) decrease. The decrement of the charging current ($i_{C2}$) of the capacitor (212) make the collector current of the second transistor (252) further decrease. Thus, there is interaction between the decrement of the collector current and the decrement of the charging current ($i_{C2}$). Therefore, shown in FIG. 4(*a*), the charging current ($i_{C2}$) of the capacitor (212) immediately rapidly decreases, whereby the second transistor (252) is also turned to off-state rapidly. As a results, no current is supplied from the power supply (10) to the load (30).

In the timer device of FIG. 3, when time corresponding to the time constant already proceeds, the loss of power in the resistor (360) happens to be. Since the timer device of FIG. 3 cuts off the current at the instance that the current supplied from the power supply (10) to the load (30) begins to decrease, it can operate in stable-state of the current supplied to the load (30) and can just operate the sequential operation.

Other embodiments and modification of the invention are of course possible. In a modification, the transistors (216, 252), the diode (214), the capacitor (212) and the power supply (10) shown in FIG. 1 and FIG. 3 may be disposed with inversed polarity. And the transistors may be replaced with active elements having the same function.

The timer device of the invention as mentioned above provide effects that it can reduce the loss of power in open-state of the switch and the recovering time to prepare for the sequential operation, and make the magnitude of the current supplied from the power supply to the load stable.

Although the present invention has been described in terms of a preferred embodiment, it will be appreciated that various modifications and alterations might be made by those skilled in the art without departing from the spirit and scope of the invention.

What is claimed is:

1. A timer device for controlling the current supplied from a power supply to a load using an on/off switch, the timer device comprising:

a time-setting part which is charged by the current flowing from said power supply, said time-setting part setting up a load current-supply period during which the current can flow between said power supply and said load;

a current-controlling part which controls the current to flow from said power supply to said load during said load current-supply period determined by said time-setting part; and an on/off switch which controls said time-setting part to start to operate at the opening instance thereof.

2. A timer device according to claim 1, characterized in that said time-setting part is charged by said power supply when said switch is in an open-state, wherein said time-setting part starts to be discharged when the switch is closed, and wherein said load current-supply period is determined by the period of time from the opening instance of said switch to the instance that the magnitude of the current in the capacitor comes down a specified value.

3. A timer device according to claim 2, characterized in that said time-setting part comprises:

a capacitor charged by said power supply;

a diode disposed between a positive electrode of said power supply and said capacitor with reverse-biased connection to said power supply;

a PNP transistor which has its emitter connected to said power supply and said load, and its base connected to the node disposed between said diode and said capacitor; and a first resistor disposed between the negative electrode of said power supply and said capacitor, and said current-controlling part comprises:

an NPN transistor which has its base connected to the collector of said PNP transistor and the negative electrode of said power supply, and its emitter connected to the negative electrode of said power supply, and its collector connected to said load, whereby said current-controlling part has no current flow from said power supply to said load if the magnitude of the current flowed through the collector of said PNP transistor in open-state of said switch comes down under a specified value.

4. A timer device according to claim 2, characterized in that said time-setting part comprises:

a capacitor charged by said power supply;

a diode disposed between a positive electrode of said power supply and said capacitor with reverse-biased connection to said power supply;

a PNP transistor which has its emitter connected to the positive electrode of said power supply and said load, and its base connected to the node disposed between said diode and said capacitor; and a first resistor which connects said NPN transistor with said capacitor, and said current-controlling part comprises:

an NPN transistor which has its base connected to the negative electrode of said power supply, and its collector connected to said load;

and a second resistor disposed between the collector and the emitter of said NPN transistor, whereby said current-controlling part has no current flow from said power supply to said load if the magnitude of the current flowed through the collector of said PNP transistor in open-state of said switch comes down under a specified value.

5. A timer device according to claim 3, characterized in that one terminal of said switch is connected to the node disposed between the positive electrode of said power supply and said diode, and the other terminal of said switch is connected to the node disposed between the negative electrode of said power supply and said capacitor.

6. A timer device according to claim 4, characterized in that one terminal of said switch is connected to the node disposed between the positive electrode of said power supply and said diode, and the other terminal of said switch is connected to the node disposed between the negative electrode of said power supply and said capacitor.

* * * * *